US006488524B2

(12) United States Patent
Endo

(10) Patent No.: US 6,488,524 B2
(45) Date of Patent: Dec. 3, 2002

(54) HALF-FITTING PREVENTION CONNECTOR

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/726,508

(22) Filed: Dec. 1, 2000

(65) Prior Publication Data

US 2001/0003073 A1 Jun. 7, 2001

(30) Foreign Application Priority Data

Dec. 1, 1999 (JP) ..... 11-342314

(51) Int. Cl.[7] ..... H01R 13/627
(52) U.S. Cl. ..... 439/353
(58) Field of Search ..... 439/352, 353, 439/357, 489, 928, 923

(56) References Cited

U.S. PATENT DOCUMENTS

| | | | | | |
|---|---|---|---|---|---|
| 5,217,385 | A | * | 6/1993 | Inouse et al. | 439/353 |
| 5,217,390 | A | * | 6/1993 | Nozaki et al. | 439/489 |
| 5,827,086 | A | * | 10/1998 | Fukuda | 439/357 |
| 5,848,912 | A | * | 12/1998 | Okabe | 439/489 |
| 6,065,991 | A | * | 5/2000 | Fukuda | 439/352 |
| 6,095,843 | A | * | 8/2000 | Kaneko et al. | 439/352 |
| 6,106,321 | A | | 8/2000 | Yoshida et al. | 439/352 |

FOREIGN PATENT DOCUMENTS

| | | | |
|---|---|---|---|
| EP | 0949717 A2 | 10/1999 | H01R/13/627 |
| JP | 5-81967 | 11/1993 | H01R/13/639 |
| JP | 10-189145 | 7/1998 | H01R/13/64 |

* cited by examiner

*Primary Examiner*—Tulsidas Patel
*Assistant Examiner*—Phuong K T Dinh
(74) *Attorney, Agent, or Firm*—Sughrue Mion, PLLC

(57) ABSTRACT

A half-fitting prevention connector (1) including a female connector (2) including a female housing (4), and a male connector (3) including a male housing (5) fittable to the female housing (4). A pair of lock arms (9) elastically deformable inwardly and downwardly, are formed on an upper portion of the female housing (4). Lock claws (8) are respectively formed on front ends of the lock arms (9), and have pressing surfaces (15) on front ends thereof and sliding surfaces (16) on outer surfaces thereof. A pair of operating walls (11) are formed on an upper portion of the male housing (5), and have locking engagement surfaces (7) on rear ends thereof and first tapering surfaces (12) which are inclined to gradually approach each other toward the rear ends of the operating walls (11) from front ends of the operating walls (11). A resilient member (10) is attachable to the male housing (5) so as to extend between the locking engagement surfaces (7). Guide grooves (14) are respectively formed in lower surfaces of the operating walls (11), and include second tapering surfaces (13) having width substantially equal to width of the lock claws (8). The second tapering surfaces (13) are downwardly, forwardly slanted in a fitting direction of the male housing (5).

10 Claims, 4 Drawing Sheets

HALF-FITTING PREVENTION CONNECTOR

BACKGROUND OF THE INVENTION

1. Field of the Invention

The present invention relates to a half-fitting prevention connector for use in an electric system of a vehicle or the like, which comprises a pair of male and female connectors having a half-fitting prevention function.

The present application is based on Japanese Patent Application No. Hei. 11-342314, which is incorporated herein by reference.

2. Description of the Related Art

Heretofore, half-fitting prevention connectors have been known as disclosed in Unexamined Japanese Utility Model Publication No. Hei. 5-81967 and Unexamined Japanese Patent Publication No. Hei. 10-189145. Such a conventional half-fitting prevention connector is shown in FIG. 5. The half-fitting prevention connector 51 comprises a pair of male and female connectors 54 and 55, and male terminals 52 are mounted within the male connector 54 while female terminals 53 are mounted within the female connector 55. Springs 56 are mounted in the female connector (one connector) 55, and serve to urge the mating connector in an anti-fitting direction, and a lock mechanism 57 is provided on the male and female connectors 54 and 55.

The male connector (the other connector) 54 has a box-shape defined by a top plate 58, a bottom plate 59 and side plates 60, and has open front and rear sides. This male connector, having the plurality of male terminals 52 received therein, can be fitted into the female connector 55. When the male and female connectors 54 and 55 are fitted together, the male terminals 52 are respectively fitted into and electrically connected to the plurality of female terminals 53 received in the female connector 55.

Notches are formed in each of the opposite side plates 60 at a central portion thereof, and a retaining piece portion 61, lying between the notches, is formed integrally with the side plate 60, and extends forwardly, the retaining piece portion 61 forming part of the lock mechanism 57. A distal end of this retaining piece portion 61 is disposed slightly rearwardly of a front edge of the side plate 60, and the retaining piece portion 61 has such elasticity as to be flexed slightly outwardly. A retaining claw 62 is formed at a front end of the retaining piece portion, and projects inwardly.

Spring receiving portions 63, each receiving the spring 56 and supporting a rear end of the spring 56, are formed at opposite sides of the female connector 55, respectively. A forwardly-extending spring guide rod 64 is provided within each of the spring receiving portions 63. A movable cover 65, having open front and rear sides, is mounted on the outer periphery of the female connector 55 so as to slide forward and rearward. Spring receiving portions 66 are formed respectively at opposite side portions of the movable cover 65, and cover the outer peripheral portions of the spring receiving portions 63, respectively. The front end of each spring 56 urges the front end of the associated spring receiving portion 66 forward. Retaining holes 70, forming part of the lock mechanism 57, are formed respectively in opposite side plates of the female connector 55.

Slots 67, formed in a top plate of the movable cover 65, and projections 68, formed on a top plate of the female connector 55, cooperate with each other to limit the forward movement of the movable cover 65 caused by the resilient force of the springs 56.

In the half-fitting prevention connector 51 of the above construction, when the pair of male and female connectors 54 and 55 are mated with each other at their front ends, and are fitted together, the front portion of the female connector 55 is first fitted into the front portion of the male connector 54, and then the retaining claws 62 are brought into sliding contact with the opposite side plates 69 of the female connector 55, respectively, while outwardly elastically deforming the retaining piece portions 61, respectively. As a result, the distal ends of the retaining piece portions 61, as well as the retaining claws 62, abut respectively against the front end surfaces of the spring receiving portions 66, so that the movable cover 65 is moved rearward while compressing the springs 56.

At this time, when the male and female connectors 54 and 55 are further pushed toward each other, the springs 56 are further compressed, and also the retaining claws 62 are retainingly engaged in the retaining holes 70, respectively, and the elastically-deformed retaining piece portions 61 are restored into their initial condition, and therefore the front ends of the retaining piece portions 61 are disengaged from the front end surfaces of the spring receiving portions 66, respectively. Then, when the above fitting force is weakened or removed, the movable cover 65 is returned to its initial position by the resilient force of the springs 56, and the male and female connectors 54 and 55 are completely fitted together, and the male terminals 52 are electrically connected to the female terminals 53, respectively. The outer surfaces of the opposite side plates 60 are held in contact with the inner surfaces of the spring receiving portions 66, respectively, and therefore the retaining piece portions 61 can not be flexed outwardly. Therefore, each retaining claw 62 will not be disengaged from the retaining hole 70, and the male and female connectors 54 and 55 are completely retained relative to each other by the lock mechanism 57.

However, if the pushing force is weakened or removed during the fitting operation before the retaining claws 62 of the lock mechanism 57 are retainingly engaged respectively in the retaining holes 70, that is, in a half-fitted condition of the male and female connectors 54 and 55, the male connector 54 is pushed back by the resilient force of the springs 56, and therefore such a half-fitted condition can be detected.

In the above half-fitting prevention connector, however, the two retaining piece portions 61 are provided respectively at the right and left sides spaced from each other, and therefore there are occasions when the right and left forces are not applied uniformly, depending on the mounting position of the male and female connectors 54 and 55 and the direction of fitting of the two connectors. And besides, in some cases, the retaining claws 62 are fitted respectively into the retaining holes 70 at different timings, or only one of the retaining claws 62 is fitted into the corresponding retaining hole 70 because of the presence of a play in the upward, downward, right or left direction. This has invited a problem that a half-fitted condition is mistaken for the completely-fitted condition, and is overlooked.

And besides, it is difficult to achieve a compact design since the movable cover 65 and the springs 56 are both required, and the number of the component parts increases, which leads to a problem that the cost increases.

Furthermore, when the movable cover 65 is damaged, the locking can not be effected, and this problem, which should be overcome in order to enhance the reliability of the connector, remains unsolved.

SUMMARY OF THE INVENTION

With the above problems in view, it is an object of the present invention to provide a half-fitting prevention connector in which a pair of male and female connectors are prevented from being kept in a half-fitted condition during a fitting connection between the two connectors, and also the locking of the two connectors in a completely-fitted condition is positively effected.

To achieve the above object, according to the first aspect of the present invention, there is provided a half-fitting prevention connector which comprises a first connector including a first housing, a second connector including a second housing fittable to the first housing, a pair of lock arms elastically deformable inwardly and downwardly, the lock arms being formed on an upper portion of the first housing, lock claws respectively formed on front ends of the lock arms, the lock claws having pressing surfaces on front ends thereof and sliding surfaces on outer surfaces thereof, a pair of operating walls formed on an upper portion of the second housing, the operating walls having locking engagement surfaces on rear ends thereof and first tapering surfaces which are inclined to gradually approach each other toward the rear ends of the operating walls from front ends of the operating walls, and a resilient member attachable to the second housing, the resilient member being extended between the locking engagement surfaces.

According to the second aspect of the present invention, it is preferable that the lock arms are opposed to each other, and the operating walls are opposed to each other.

According to the third aspect of the present invention, it is preferable that the first tapering surfaces of the operating walls are inclined to gradually approach a center line extending between the first tapering surfaces.

According to the fourth aspect of the present invention, it is preferable that the sliding surfaces of the lock claws are respectively slid on the first tapering surfaces of the operating walls while causing the lock arms to flex inwardly and gradually approach each other.

According to the fifth aspect of the present invention, it is preferable that the pressing surfaces of the lock claws abut against the resilient member to compress the resilient member, and wherein, after the lock claws respectively pass beyond the operating walls, and then, the lock arms are restored outwardly into their initial condition by their elastic restoration forces, the lock claws are respectively retained by the locking engagement surfaces of the operating walls so as to maintain a completely-fitted condition of the first housing and the second housing.

According to the sixth aspect of the present invention, it is preferable that the resilient member urges the pressing surfaces of the lock claws in a fitting direction of the second housing.

In accordance with the present invention, the provision of the conventional movable cover is not necessary, and the number of the component parts is reduced, and the compact design can be achieved, and the disadvantage, caused by damage of the movable cover, is eliminated. Accordingly, the reliability of the connector is enhanced, and besides the cost can be reduced.

The sliding surfaces of the lock claws the slide respectively along the first tapering surfaces, while inwardly elastically deforming the lock arms, respectively, and the pressing surfaces press the resilient member, and therefore the connector is positively prevented from being kept in a half-fitted condition. When the rear ends of the lock claws pass past the locking engagement surfaces, respectively, the inwardly elastically-deformed lock arms are restored outwardly into their initial condition, so that the completely-fitted condition is obtained.

Thus, this connector is shifted from the half-fitted condition into the completely-fitted condition by one action, and therefore the connector will not be kept in the half-fitted condition, and besides the completely-fitted condition can be recognized by viewing the outward restoring movement of the lock claws with the eyes. Even when a foreign object impinges on the female and male connectors, held in the completely-fitted condition, the completely-fitted condition will not be accidentally canceled since the upper surfaces of the lock claws will not be pressed down below the upper surfaces of the operating walls and the upper surface of the housing. Therefore, the reliability of the connector is further enhanced.

According to the seventh aspect of the present invention, it is preferable that the half-fitting prevention connector further comprises guide grooves respectively formed in lower surfaces of the operating walls, the guide grooves including second tapering surfaces having width substantially equal to width of the lock claws, the second tapering surface being downwardly, forwardly slanted in a fitting direction of the second housing.

In accordance with the present invention, when canceling the fitted condition of the female and male connectors, each lock claw, pressed down below the locking engagement surface to be disengaged therefrom, is withdrawn in sliding contact with the second tapering surface, and therefore the canceling operation can be effected easily, and the efficiency of the connector fitting operation can be enhanced.

DETAILED DESCRIPTION OF THE PREFERRED EMBODIMENT

Figure 1:
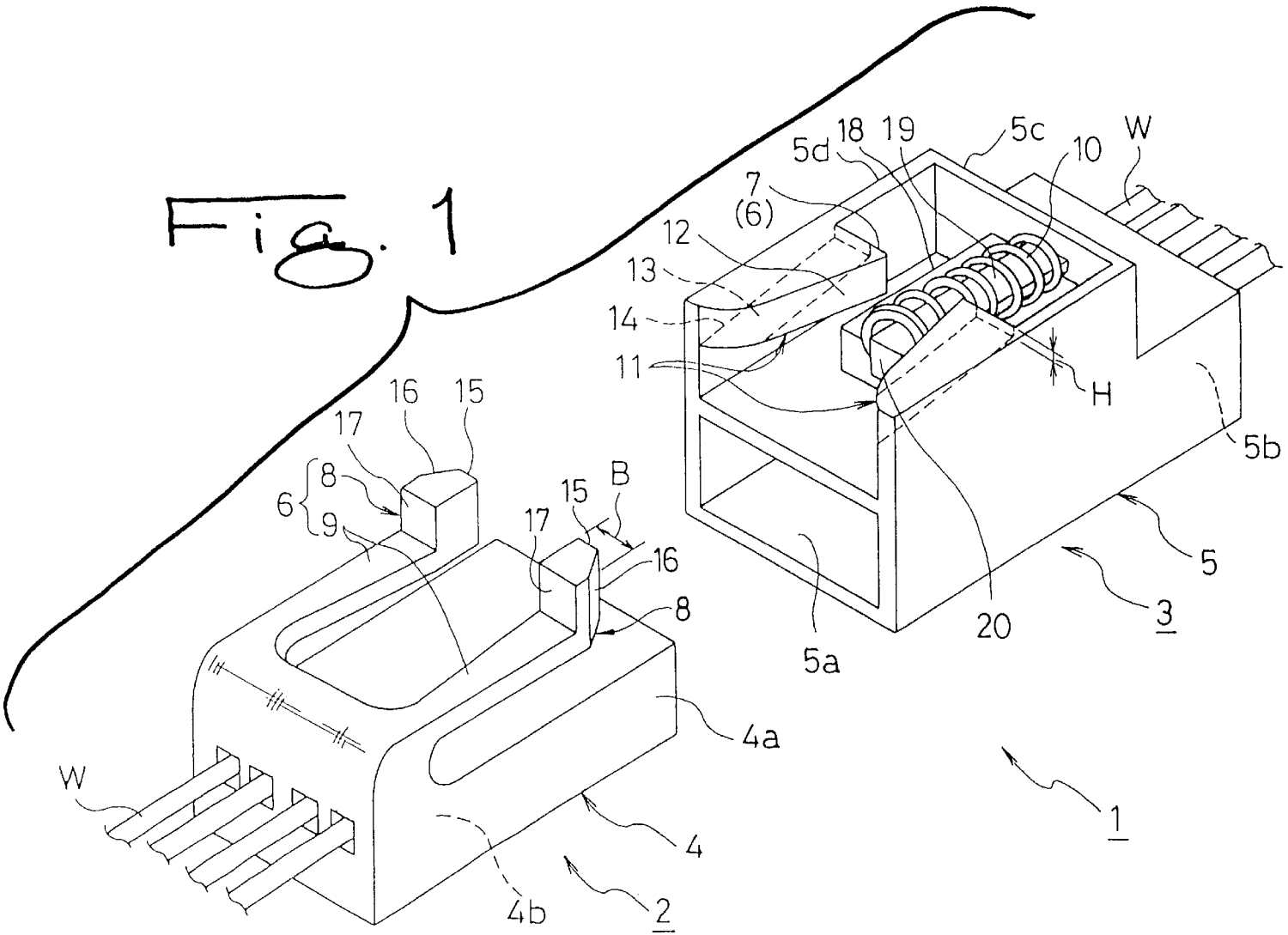
FIG. 1 is an exploded, perspective view of one preferred embodiment of a half-fitting prevention connector of the present invention.
Figure 2:
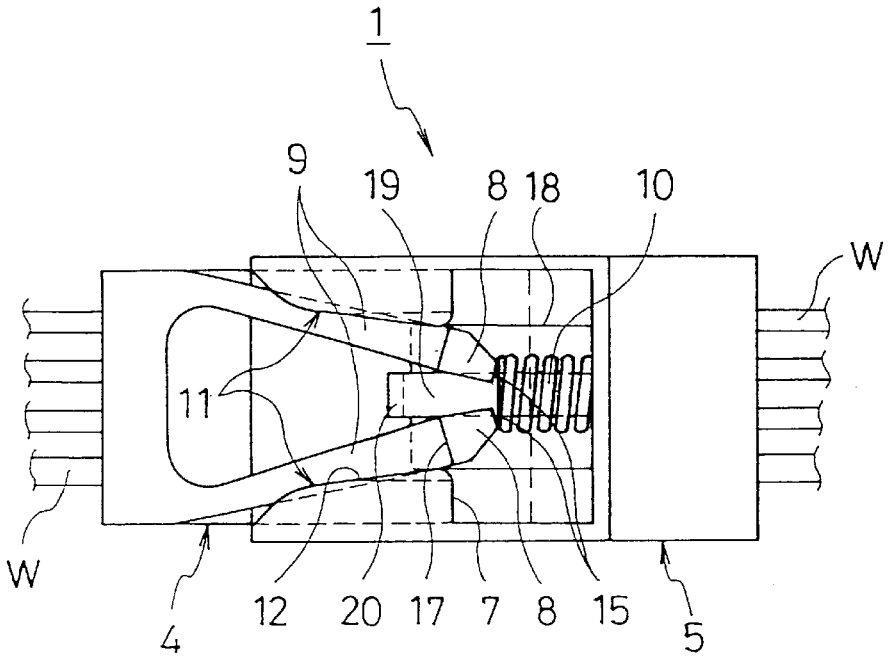
FIG. 2 is a plan view of the connector of FIG. 1 in a half-fitted condition.
Figure 3:
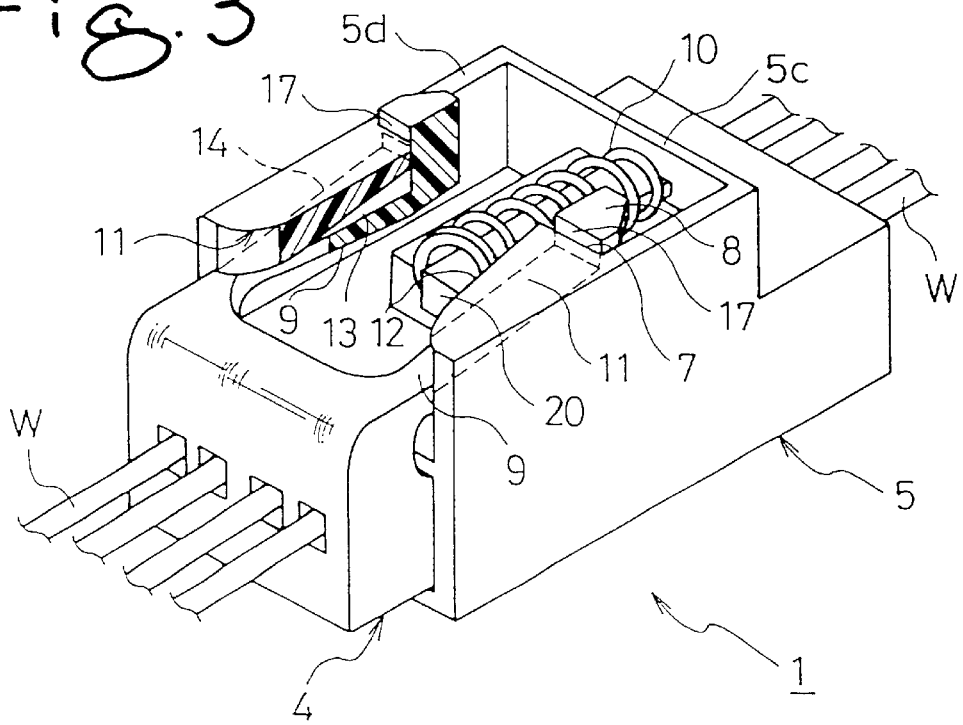
FIG. 3 is a perspective view of the connector of FIG. 1 in a completely-fitted condition.
Figure 4A:
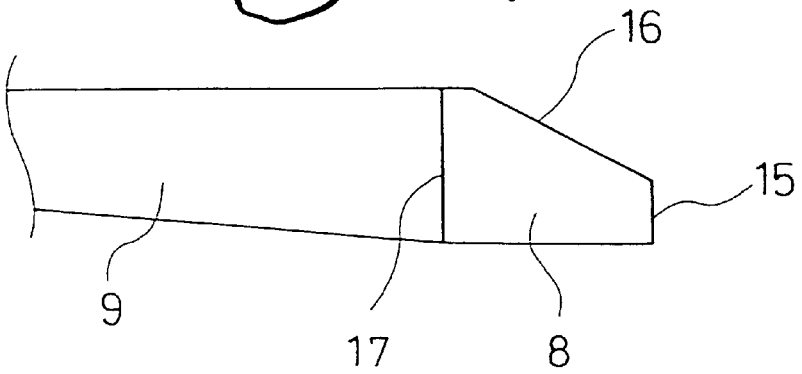
FIGS. 4A to 4C are enlarged plan views showing examples of lock claws in FIG. 1.
Figure 4B:
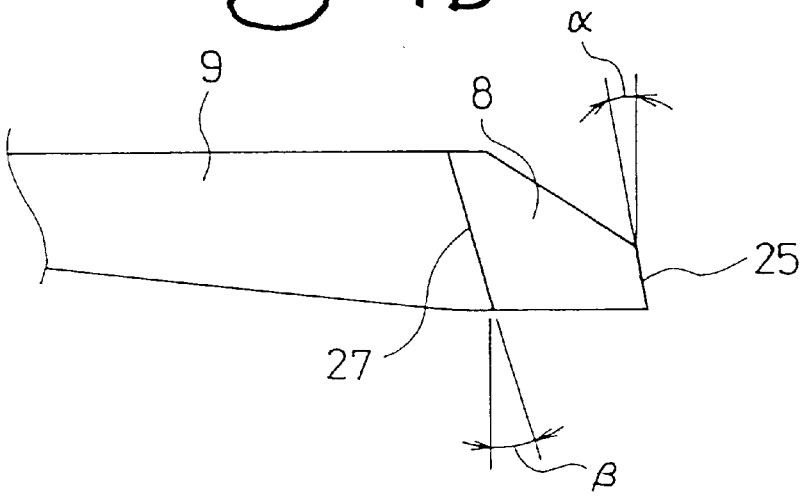
Figure 4C:
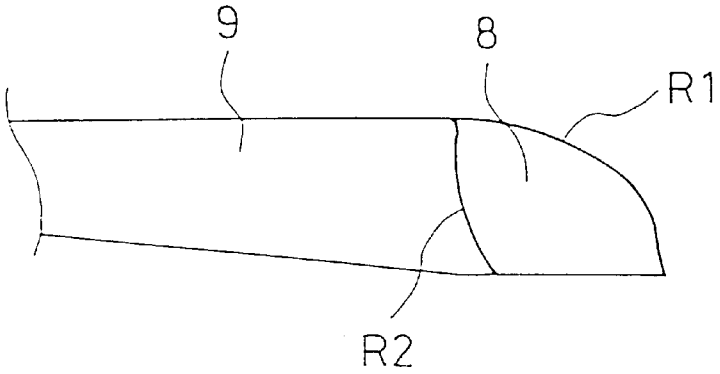
Figure 5:
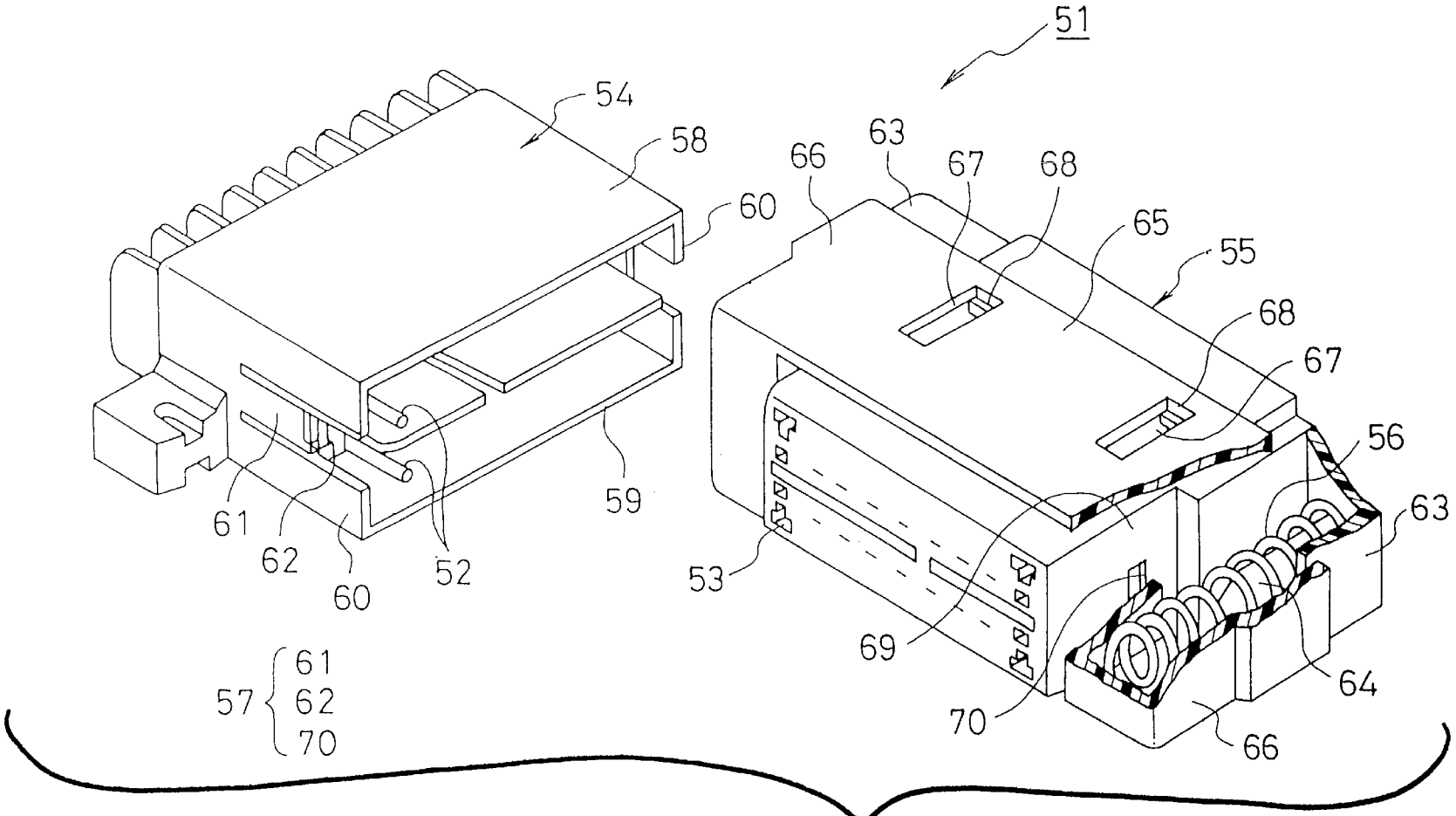
Fig. 5 PRIOR ART
FIG. 5 is an exploded, perspective view of a conventional half-fitting prevention connector.

One preferred embodiment of a half-fitting prevention connector of the present invention will now be described in detail with reference to FIGS. 1 to 4. FIG. 1 is an exploded, perspective view of one example of a half-fitting prevention connector of the present invention, FIG. 2 is a plan view of the connector of FIG. 1 in a half-fitted condition, FIG. 3 is a perspective view of the connector of FIG. 1 in a completely-fitted condition, and FIGS. 4A to 4C are enlarged plan views showing examples of lock claws in FIG. 1.

As shown in FIG. 1, the half-fitting prevention connector 1 of this embodiment includes a lock mechanism 6 for retaining a pair of female and male connectors 2 and 3 in a fitted condition, and a compression spring (resilient member) 10 attached to a male housing 5 of the male connector 3 so as to urge the female connector 2 in an anti-fitting direction, and a suitable number of connection terminals are mounted within the female connector 2, and also a suitable number of connection terminals are mounted within the male connector 3.

A pair of operating walls 11 are formed on an upper portion of the male housing 5, and have first tapering surfaces 12, respectively, which are inclined to gradually approach a center axis in a direction toward rear ends of the operating walls 11 from front ends thereof. Locking engagement surfaces 7 are formed at the rear ends of the operating walls 11, respectively, and are disposed perpendicularly to the center axis. The compression spring 10 is disposed midway between the locking engagement surfaces 7.

A pair of lock arms 9, which can be elastically deformed inwardly and downwardly, are formed on an upper portion of a female housing 4 of the female connector 2, and have lock claws 8, respectively, which can be engaged with the locking engagement surfaces 7, respectively. Each of the lock claws 8 includes a spring-pressing surface 15, formed at a front end thereof so as to abut against the compression spring 10, a sliding surface 16, formed at an outer surface thereof so as to slide along the associated first tapering surface 12, and a lock surface 17 formed at a rear end thereof so as to abut against the associated locking engagement surface 7.

A guide groove 14 is formed in a lower surface of each operating wall 11, and has a second tapering surface 13 having a width equal to a width B of the lock claw 8, and this second tapering surface 13 is slanting downwardly forwardly in a fitting direction. A rear end of the second tapering surface 13 is downwardly spaced a dimension H from the upper surface of the operating wall 11.

More specifically, a fitting chamber 5*a* for receiving the mating female housing 4 is formed in a front lower portion of the male housing 5, and terminal receiving chambers 5*b* are formed in a rear portion of the male housing 5, and the male connection terminals (not shown), each connected to a sheathed wire W, are received respectively in these terminal receiving chambers 5*b,* and are retained by housing lances of the ordinary type, respectively. A lower front portion of the female housing 4 is formed into a fitting portion 4*a* for fitting into the mating male housing 5, and terminal receiving chambers 4*b* are formed in a rear portion of the female housing 4, and the female connection terminals (not shown), each connected to a sheathed wire W, are received respectively in these terminal receiving chambers 4*b,* and are retained by housing lances of the ordinary type, respectively.

The compression spring 10 is supported at its lower side on a support bed 18, formed on the male housing 5, and can be compressed while guided by a guide rod 19 of a semi-cylindrical shape which is supported by a rear wall 5*c,* and extends forwardly.

A rear end of the compression spring 10 is received by the rear wall 5*c,* and a front end thereof is held by a retainer plate 20, retained on the guide rod 19 or the support bed 18, so that the compression spring 10 can produce a resilient force in a half-fitted condition.

Therefore, when the compression spring 10 abuts against the spring-pressing surfaces 15 at an upper portion of the front end thereof, and is compressed, the retainer plate 20, the guide rod 19 and the support bed 18 will not interfere with the spring-pressing surfaces 15 and the lock arms 9.

In the half-fitting prevention connector 1 of the above construction, for fittingly connecting the female and male connectors 2 and 3 together, the male housing 5 and the female housing 4 are opposed to each other as shown in FIG. 1, and the fitting portion 4*a* is fitted into the fitting chamber 5*a*.

Then, as shown in FIG. 2, the sliding surfaces 16 of the lock claws 8, formed respectively at the distal ends of the lock arms 9, are brought into contact with the operating walls 11, respectively, and these sliding surfaces 16, while displaced inwardly toward the center axis, slide respectively along the first tapering surfaces 12. When the fitting operation further proceeds, the spring-pressing surfaces 15 of the lock claws 8 abut against the front end of the compression spring 10 to compress the same, and the lock arms 9, while further elastically deformed inwardly, advance to a position immediately before the rear ends of the first tapering surfaces 12.

If the fitting force is removed in this half-fitted condition, the spring-pressing surfaces 15 are pressed by the resilient force of the compression spring 10, so that the female connector 2 is pushed back in the anti-fitting direction through the lock arms 9, and therefore the half-fitted condition can be positively recognized.

In the above-mentioned condition, when the female housing 4 is pushed in the fitting direction, the lock claws 8 pass past the first tapering surfaces 12, respectively, so that the inwardly-flexed lock arms 9 are restored into their initial condition. As a result, the lock surfaces 17 of the lock claws 18 are retained by the locking engagement surfaces 7 of the operating walls 11, respectively, so that the two connectors are held in a completely-fitted condition.

In this completely-fitted condition, the lock claws 8 are abutted against or disposed close to opposite side walls 5*d* of the male housing 5, respectively, as shown in FIG. 3, and therefore this completely-fitted condition can be easily recognized with the eyes.

For canceling the fitting connection between the female and male connectors 2 and 3, the upper surfaces of the lock claws 8 are pressed down to a level below the upper surfaces of the operating walls 11 (see FIG. 3), so that the lock arms 9 are elastically deformed downwardly. Then, when the female housing 4 is pulled in the anti-fitting direction, the upper surfaces of the lock claws 8 are guided into the guide grooves 14, respectively, and slide along the second tapering surfaces 13, respectively, and are withdrawn through the front end of the male housing 5. Thus, the fitted condition of the female and male connectors 2 and 3 can be easily canceled.

As described above, in the half-fitting prevention connector 1 of this embodiment, the operating walls 11 are formed on the upper portion of the male housing 5, and have the first tapering surfaces 12, respectively, which are inclined to gradually approach the center axis in the direction from the front end of the male housing toward the rear end thereof. The locking engagement surfaces 7 are formed at the rear ends of the operating walls 11, respectively, and the compression spring 10 is disposed midway between the locking engagement surfaces 7.

The lock arms 9, which can be elastically deformed inwardly and downwardly, are formed on the upper portion of the female housing 4, and have the lock claws 8, respectively, which can be engaged with the locking engagement surfaces 7, respectively. Each of the lock claws 8 includes the spring-pressing surface 15, formed at the front end thereof so as to abut against the compression spring 10, and the sliding surface 16 formed at the outer surface thereof so as to slide along the associated first tapering surface 12.

Therefore, the provision of the conventional movable cover is not necessary, and the number of the component parts is reduced, and the compact design can be achieved, and the disadvantage, caused by damage of the movable cover, is eliminated. Therefore, the reliability of the connector is enhanced, and besides the cost can be reduced.

More specifically, the sliding surfaces 16 of the lock claws 8 slide respectively along the first tapering surfaces 12, while inwardly elastically deforming the lock arms 9, respectively, and the spring-pressing surfaces 15 press the compression spring 10, and therefore the connector is positively prevented from being kept in a half-fitted condition.

When the rear ends of the lock claws 8 pass past the locking engagement surfaces 7, respectively, the inwardly elastically-deformed lock arms 9 are restored outwardly into their initial condition, and at the same time the completely-fitted condition is obtained.

Thus, this connector is shifted from the half-fitted condition into the completely-fitted condition by one action, and therefore the connector will not be kept in the half-fitted condition, and besides since the lock claws 8 are moved outwardly, the completely-fitted condition can be confirmed also with the eyes.

Even when a foreign object accidentally impinges on the female and male connectors 2 and 3, held in the completely-fitted condition, from the upper side, the completely-fitted condition will not be canceled since the upper surfaces of the lock claws 8 will not be pressed down below the upper surfaces of the operating walls 11. And, in this condition, the spring-pressing surfaces 15 are disengaged from the front end of the compression spring 10, and therefore even if the upper surfaces of the lock claws 8 move downward below the upper surfaces of the operating walls 11, the fitted condition will not be canceled unless the female housing 4 is pulled in the anti-fitting direction.

The guide groove 14 is formed in the lower surface of each operating wall 11, and has the second tapering surface 13 having the width equal to the width B of the lock claw 8, and this second tapering surface 13 is slanting downwardly forwardly in the fitting direction. With this construction, when canceling the fitted condition of the female and male connectors 2 and 3, each lock claw 8, pressed down below the locking engagement surface 7, is withdrawn in sliding contact with the second tapering surface 13.

Therefore, the reliability of the connector is further enhanced, and also the efficiency of the operation for canceling the fitted condition is enhanced.

The present invention is not limited to the above embodiment, and suitable modifications can be made. For example, in this embodiment, the spring-pressing surface 15 and the lock surface 17 of the lock claw 8 are defined respectively by vertical surfaces perpendicular to the fitting direction (see FIG. 4A). However, in view of the operation, a spring-pressing surface 25 may be inclined at an angle $\alpha$, and a lock surface 27 may be slanting downwardly forwardly at an angle $\beta$, as shown in FIG. 4B.

As shown in FIG. 4C, each sliding surface may be replaced by a sliding surface R1 defined by an arcuate surface. The upper surface of the lock claw 8 may be slanting downwardly forwardly. In view of the compression spring-pressing operation, there may be used an arrangement in which the first tapering surface is provided on a front half portion of the operating wall 11 while a rear half portion thereof is a vertical surface parallel to the fitting axis.

As described above, in the half-fitting prevention connector of the present invention, the lock arms, which can be elastically deformed inwardly and downwardly, are formed on the upper portion of the housing, and have the lock claws formed at the front ends thereof, respectively, and each of the lock claws includes the spring-pressing surface, formed at the front end thereof so as to abut against the resilient member, and the sliding surface formed at the outer surface thereof. The operating walls are formed on the upper portion of the housing of the other connector, and have the first tapering surfaces, respectively, which are inclined to gradually approach the center axis in the direction from the front end of the other housing toward the rear end thereof, and can be disposed in sliding contact with the sliding surfaces, respectively, and the locking engagement surfaces for engagement respectively with the lock claws are formed at the rear ends of the operating walls, respectively, and the resilient member is disposed midway between the locking engagement surfaces.

Therefore, the provision of the conventional movable cover is not necessary, and the number of the component parts is reduced, and the compact design can be achieved, and the disadvantage, caused by damage of the movable cover, is eliminated. Therefore, the reliability of the connector is enhanced, and besides the cost can be reduced.

In the above half-fitting prevention connector, the guide groove is formed in the lower surface of each of the operating walls, and has the second tapering surface having the width substantially equal to the width of the lock claw, and the second tapering surface is slanting downwardly forwardly in the fitting direction. With this construction, when canceling the fitted condition of the female and male connectors, each lock claw, pressed down below the locking engagement surface to be disengaged therefrom, is withdrawn in sliding contact with the second tapering surface, and therefore the canceling operation can be effected easily, and the efficiency of the connector fitting operation can be enhanced.

What is claimed is:

1. A half-fitting prevention connector, comprising:

a first connector including a first housing;

a second connector including a second housing fittable to the first housing;

a pair of elastically deformable lock arms, the lock arms being formed on an upper portion of the first housing;

lock claws respectively formed on front ends of the lock arms, the lock claws having pressing surfaces on front ends thereof and sliding surfaces on outer surfaces thereof;

a pair of operating walls formed on an upper portion of the second housing, the operating walls having locking engagement surfaces on rear ends thereof and first tapering surfaces which are inclined to gradually approach each other toward the rear ends of the operating walls from front ends of the operating walls, said sliding surfaces sliding along said first tapering surfaces such that the lock arms are deflected; and a resilient member attachable to the second housing for urging the first connector away from the second connector, the resilient member being extended between the locking engagement surfaces.

2. The half-fitting prevention connector of claim 1, wherein the lock arms are opposed to each other, and the operating walls are opposed to each other.

3. The half-fitting prevention connector of claim 1, wherein the first tapering surfaces of the operating walls are inclined to gradually approach a center line extending between the first tapering surfaces.

4. The half-fitting prevention connector of claim 1, wherein the sliding surfaces of the lock claws are respectively slid on the first tapering surfaces of the operating walls while causing the lock arms to flex inwardly and gradually approach each other.

5. The half-fitting prevention connector of claim 2, wherein the sliding surfaces of the lock claws are respectively slid on the first tapering surfaces of the operating walls while causing the lock arms to flex inwardly and gradually approach each other.

6. The half-fitting prevention connector of claim 4, wherein the pressing surfaces of the lock claws abut against the resilient member to compress the resilient member, and wherein, after the lock claws respectively pass beyond the operating walls, and then, the lock arms are restored into their initial condition by their elastic restoration forces, the lock claws are respectively retained by the locking engagement surfaces of the operating walls so as to maintain a completely-fitted condition of the first housing and the second housing.

7. The half-fitting prevention connector of claim 5, wherein the pressing surfaces of the lock claws abut against the resilient member to compress the resilient member, and wherein, after the lock claws respectively pass beyond the operating walls, and then, the lock arms are restored into their initial condition by their elastic restoration forces, the lock claws are respectively retained by the locking engagement surfaces of the operating walls so as to maintain a completely-fitted condition of the first housing and the second housing.

8. The half-fitting prevention connector of claim 1, wherein the resilient member urges the pressing surfaces of the lock claws in a fitting direction of the second housing.

9. The half-fitting prevention connector of claim 1, further comprising guide grooves respectively formed in lower surfaces of the operating walls, the guide grooves including second tapering surfaces having width substantially equal to width of the lock claws, the second tapering surface being downwardly, forwardly slanted in a fitting direction of the second housing.

10. The half-fitting prevention connector of claim 6, further comprising guide grooves respectively formed in lower surfaces of the operating walls, the guide grooves including second tapering surfaces having width substantially equal to width of the lock claws, the second tapering surfaces being downwardly, forwardly slanted in a fitting direction of the second housing.

* * * * *